US005394065A

United States Patent [19]

Rimmer

[11] Patent Number: 5,394,065

[45] Date of Patent: Feb. 28, 1995

[54] CIRCUIT FOR SUPPLYING CURRENT TO A DISCHARGE TUBE

[75] Inventor: Phillip J. Rimmer, Walthamstow, Great Britain

[73] Assignee: Tunewell Technology Limited, London, England

[21] Appl. No.: 973,381

[22] Filed: Nov. 9, 1992

[51] Int. Cl.[6] ..... H05B 41/16

[52] U.S. Cl. ..... 315/277; 315/246; 315/106; 315/107; 315/DIG. 7

[58] Field of Search ..... 315/277, 276, 278, 106, 315/107, DIG. 7, 246

[56] References Cited

U.S. PATENT DOCUMENTS

| | | | |
|---|---|---|---|
| 1,612,387 | 12/1926 | Machlett | 315/246 |
| 2,313,961 | 3/1943 | Oglesbee | 315/277 |
| 4,859,914 | 8/1989 | Summa | 315/206 X |
| 5,019,751 | 5/1991 | Flory, IV et al. | 315/225 X |
| 5,173,643 | 12/1992 | Sullivan et al. | 315/276 |

FOREIGN PATENT DOCUMENTS 0408121 1/1991 European Pat. Off. .

*Primary Examiner*—Robert J. Pascal
*Assistant Examiner*—Haissa Philogene
*Attorney, Agent, or Firm*—Brooks & Kushman

[57] ABSTRACT

An electrical arrangement is disclosed comprising a circuit to supply current to a discharge lamp. The circuit comprises a lower voltage source of alternating current in the form of a square wave generator. The current is fed to two transformers, the primary windings of which are connected in series, the transformers being physically located immediately adjacent the electrodes of a discharge tube. The secondaries of the transformers are also connected in series, and are connected to the electrodes of the discharge lamp. Only extremely short high-tension leads are provided extended between the secondaries of the transformer and the electrodes. Each transformer is a transformer having a coupling factor in excess of 0.98, and each transformer may be formed of a core on which a secondary winding is wound, the primary winding consisting of the end of the region of a flexible substrate with a conductive material coated on the two opposed faces thereof, apart from in the end region where only one face is provided with the coating, the end region being coiled around the secondary windings and being provided with means to establish electrical connection between the conductive material on the inner face of the winding and the conductive material on the exterior of the winding.

22 Claims, 3 Drawing Sheets

CIRCUIT FOR SUPPLYING CURRENT TO A DISCHARGE TUBE

TECHNICAL FIELD

The present invention relates to an electrical arrangement, and more particularly relates to an electrical arrangement adapted to supply a discharge tube. The invention also relates to a transformer.

BACKGROUND OF THE INVENTION

A typical discharge tube operates at a high frequency and at a high voltage. Typically, the power supply available is at a lower voltage than is necessary for the operation of the discharge tube, and consequently the voltage has to be "stepped-up" using an appropriate transformer. Leads extend from the transformer to the ends of the discharge tube, these leads carrying the high voltage, high frequency current. These leads are relatively expensive, since the leads have to be well insulated, because of high voltage carried by the leads, but also the leads may typically form a dipole, meaning that the leads radiate significant amounts of energy. This can cause interference in nearby electrical apparatus.

SUMMARY OF THE INVENTION

The present invention seeks to provide an improved electrical arrangement.

According to one aspect of this invention there is provided an electrical arrangement, said arrangement comprising a circuit adapted to supply current to a discharge tube, the arrangement comprising a source of relatively low voltage alternating current, two transformers, each having a coupling factor in excess of 0.95, the transformers each being located adjacent an electrode of a discharge tube and being connected thereto, the source of low voltage alternating current being connected to said transformers so that said transformers provide an alternating high voltage current to the discharge tube.

Preferably each transformer has a coupling factor in excess of 0.98.

Conveniently each transformer has a coupling factor of approximately 1.

Preferably the secondary windings of the two transformers are connected together in series, and are connected to the electrodes of the discharge tube.

Conveniently the primary windings of the two transformers are connected in series.

Advantageously a single conductor is used to connect the primary and secondary windings of the two transformers in series.

Preferably the low voltage source of alternate current comprises a square wave generator developing anti-phase square wave signals.

Conveniently the anti-phase square wave signals are passed through respective inductors before being supplied to said two transformers.

Preferably means are provided for passing the signal from said inductors to said two transformers which comprise a flexible substrate provided with a layer of a conductor, forming the necessary conductive path, on each of the two opposed sides of the flexible substrate.

Conveniently at least one end region of the flexible substrate is such that a conductive layer is only provided on one side of the flexible substrate, that region being wound in a spiral to form the primary winding of a transformer, the secondary winding being wound on to a core located within said spiral, means being provided to connect the conductive layer on the interior of the spiral with a conductive layer on the exterior of the substrate to complete the appropriate circuit.

The arrangement may be provided with means to detect abnormal operation of the arrangement and to cut off the power supplied to the arrangement in the event that abnormal operation is detected.

Preferably resonance capacitor means are provided connected across the conductive paths supplying the primary windings of the transformers.

Conveniently said capacitor is connected across the outputs of said further transformer.

Preferably a node connected to one terminal of the capacitor is connected, through a reverse bias diode, to one terminal of a capacitor, the other terminal of which is earth, that terminal of the capacitor being connected through a Zener diode having a predetermined break-down voltage to a comparator provided with a reference voltage, the comparator being adapted to provide an output signal when the voltage present on the node exceeds a predetermined threshold.

Advantageously a node on the conductor connecting the secondary and/or primary winding of said two transformers is connected to a Zener diode having a predetermined break-down voltage, and thence to a comparator adapted to compare a signal derived from the Zener diode with a reference voltage, the comparator being adapted to generate an output to activate a power cut-off device.

Preferably means are provided, between the node and the Zener diode, to shift the voltage.

Conveniently the means to shift the voltage comprise the series connection of a resistance and a capacitance, the output terminal of the capacitance being connected to earth by means of a further resistance or diode.

Preferably the comparator is provided with a latch.

The invention also relates to an electrical arrangement comprising a transformer, the transformer being constituted by a core having a secondary winding formed directly on the core, there being a primary winding surrounding the secondary winding, the primary winding being constituted by an end region of a conductive feed, which conductive feed comprises a flexible substrate with conductive material formed on each of the two opposed sides of the flexible substrate, said conductive material not being present on one face of the substrate in a terminal regional thereof, said terminal region being wound to form a coil about the secondary, means being provided to retain the turns of the coil together and to electrically connect the end of the conductive material on said one face of the insulating element with the region of conductive material on the other face of the insulating element.

Preferably said interconnecting means comprise a metallic clip having two limbs.

Conveniently wherein the core is a "E" core.

BRIEF DESCRIPTION OF THE DRAWINGS

In order that the invention may be more readily understood, and so that further features thereof may be appreciated, the invention will now be described, by way of example, with reference to the accompanying drawings, in which.

DESCRIPTION OF THE PREFERRED EMBODIMENTS

Figure 1:
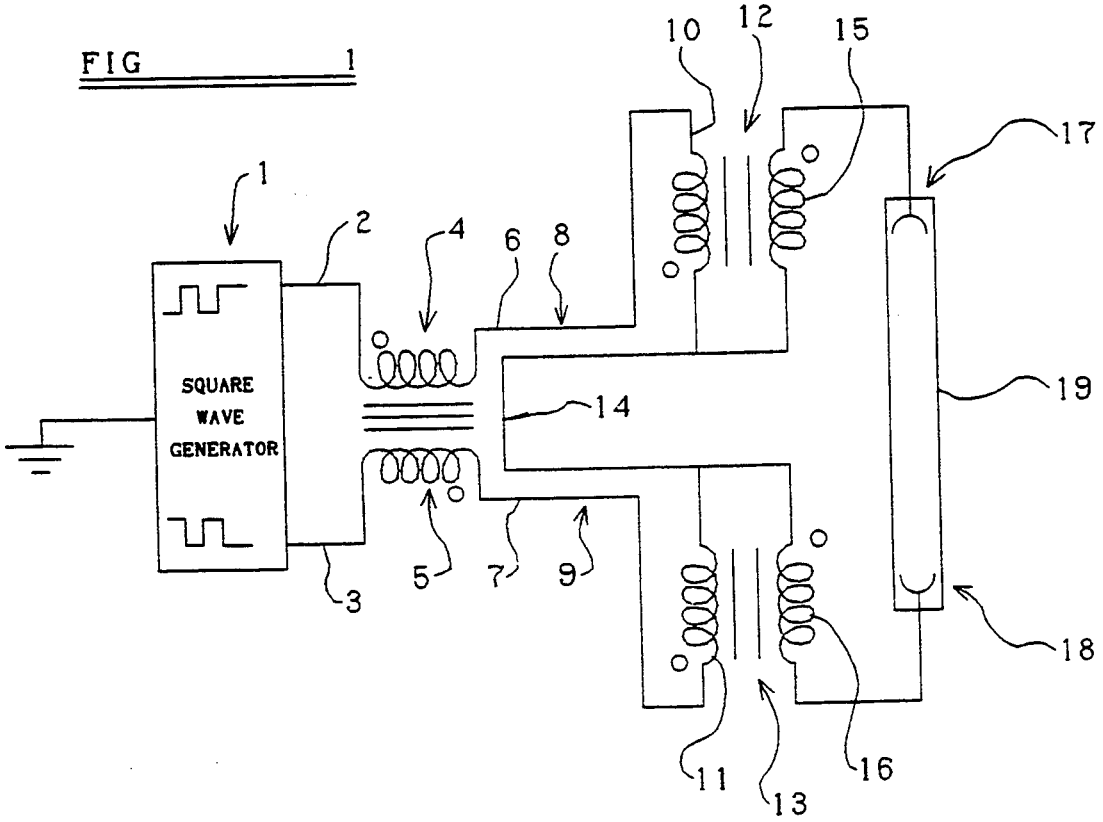
FIG. 1 is a part schematic circuit diagram of an electrical arrangement in accordance with the invention comprising a circuit supplying current to a discharge tube.

Referring initially to FIG. 1 of the accompanying drawings, the underlying concept of the present invention is that two transformers are provided for an electrical discharge tube, one located immediately adjacent each electrode of the discharge tube, a low voltage signal being supplied to the transformers and being stepped-up to provide the high voltage at the ends of the discharge tube. Because the transformers are located at the ends of the discharge tube, there is no need to provide high tension leads extending from the transformer to the electrodes, thus minimizing expense and reducing the risk of interference in nearby electrical apparatus.

Considering the circuit illustrated in FIG. 1, it is to be understood that the circuit may be intended for use in a situation where a twelve-volt supply is available, such as in a motor vehicle. However, it is to be understood that the invention is not limited to this particular application.

A square wave generator 1 is provided having two outputs 2,3. The square wave generator is such that it generates two square waves in anti-phase, with a frequency of between 20 and 50 KHz. Each square wave will have a range of 0 volts to 12 volts.

The outputs 2,3 of the square wave generator are fed to input terminals of two inductors 4,5 with balanced coupled windings having outputs 6,7. The inductors 4,5 are provided primarily as an impedance which limits the current. However, the coupling between the windings also help ensure that the voltages present at the low outputs 6,7 of the coupled windings are as similar as possible.

The outputs 6,7 of the coupled windings are connected, by means of flexible leads 8,9 (which will be described hereinafter in greater detail) to the primary windings 10,11 of two transformers 12,13. The other ends of the primary windings 10,11 are interconnected by part of the flexible leads 8,9 illustrated as the conductor 14. The conductor 14 also interconnects one end of each of the secondary windings 15,16 of the transformers 12,13. The outputs of the secondary windings 15,16 are connected to electrodes 17,18 in a discharge tube 19.

The primary windings of the two transforms are connected in series and thus carry the same current. The secondary windings are also connected in series and thus carry the same current.

It can be seen that the windings of the transformers 12,13 are such that the signals present on the electrodes 17,18 are in anti-phase.

The transformers 12,13 are very close-coupled transformers, having a coupling factor of at least 0.95, preferably in excess of 0.98 and advantageously approximately 1.

It is to be appreciated that the transformers 12,13 are located as close as possible to the ends of the discharge tube 19, so that the lead extending from the secondary winding 15,16 of each transformer to the associated electrode 17,18 is as short as possible. This minimizes expense, since no long high-tension leads have to be provided and also minimizes interference with nearby electrical apparatus.

It is to be appreciated that the transformer 4 must be considered as being of benefit, but is not essential.

Figure 2:
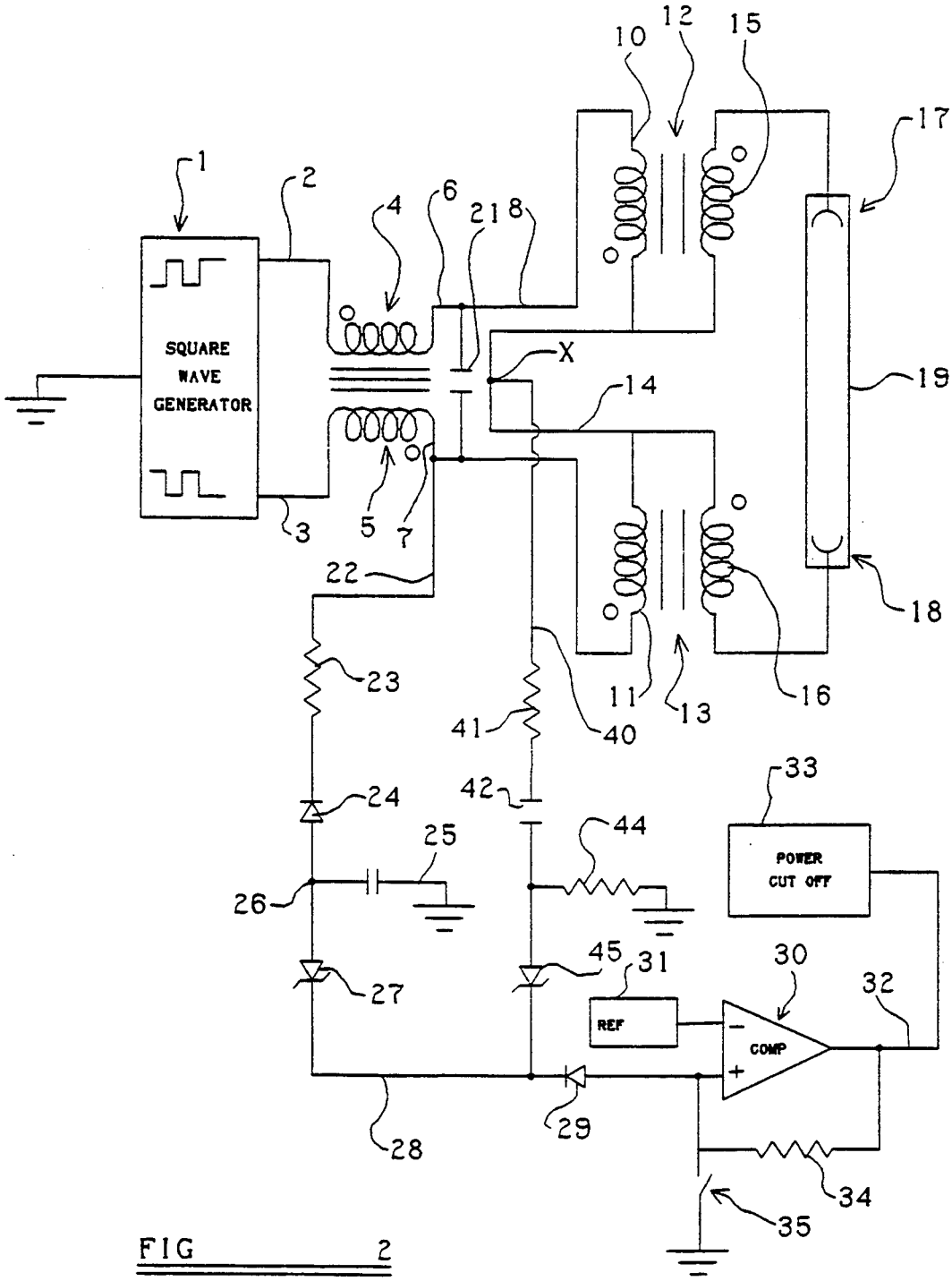
FIG. 2 is a part schematic circuit diagram of an alternative electrical arrangement in accordance with the invention comprising a circuit for supplying a current to an electric discharge tube, the circuit incorporating power cut-off means.

FIG. 2 illustrates a modified electrical arrangement in accordance with the invention. The components described with reference to FIG. 1 are present in the embodiment of FIG. 2, together with additional components. The component present in FIG. 2, which are also present in FIG. 1 are identified by the same reference numerals and, for the sake of brevity, will not be redescribed.

Initially it is to be observed that in the embodiment of FIG. 2 a capacitance 21 is provided connected across the two outputs 6,7 of the inductors 4,5. The capacitance 21 is intended to be a resonance capacitance, which gives enhanced line regulation.

Because of the very close coupling of the transformers 12 and 13, the voltages present at the outputs 6 and 7 of the inductors 4,5 have a precisely predetermined relationship with the voltages present on the electrodes 17 and 18 of the discharge tube 19. The discharge tube 19, when it has been "struck" is conductive, with a predetermined characteristic, which effectively limits the voltages present on the electrodes 17 and 18. As a consequence of the tight coupling of the transformers 12 and 13 the voltage present across the resonant capacitance 21 is also limited.

However, should the discharge tube 19 go "open circuit" for any reasons, due to a breakage or other failure of the discharge tube, the effect on the voltages present at the outputs 6 and 7 of the inductors 4,5 will no longer be felt. The resonating capacitance 21 will then resonate, leading to relatively high voltages being present at the outputs 6 and 7 of the inductors 4,5. This high voltage may be detected, and a power cut-off operated in response to such detection.

However, the capacitance 21 also serves another purpose in that the voltage supplied from the square wave generator 1 may vary in certain circumstances, the range of variance possibly being anywhere in the range of 8 volts to 16 volts. As the voltage drops, so the voltage present at the electrodes 17 and 18 will drop due to the very close coupling of the transformers 12 and 13. The discharge tube 19, if it has a typical characteristic, is more conducting at a higher voltage and less conducting at a lower voltage. The resonance capacitor 21 assists in keeping the voltage applied to the tube above the minimum to ensure that the tube remains "struck". The resonance also helps to minimize any RF interference.

The detection of the high voltage and the power cut-off will not be described. In the electrical arrangement of FIG. 2 a lead 22 extends from the output 7 of the inductor 5. The lead effectively connects the output of the inductor 5, through a resistance 23 and a reverse-biased diode 24 to a capacitance 25, the other terminal of which is connected to earth. The capacitance 25 thus charges up during each cycle of voltage present at the output 7 of the inductor 5. In the ordinary course of events the voltage present at the output 7 of the inductor 5 does not fall below 0 volts, and consequently the minimum potential present on the capacitance 25 is 0 volts.

The node 26 between the capacitance 25 and the reverse diode 24 is also connected to a Zener diode 27 which has a break-down voltage just in excess of 12 volts. It is thus to be understood that if the discharge tube 19 goes open-circuit for any reasons and the voltage at point 7 thus falls to less than −12 volts, due to the effect of the resonant capacitance 21, a voltage of less than −12 volts will be present on the capacitance 25, and that voltage will exceed the breakdown voltage of Zener diode 27, causing the Zener diode to become conductive.

The Zener diode 27 is connected to a rail 28 which, in turn, is connected through a further reverse biassed diode 29 to one input of a comparator 30. A reference voltage from a reference voltage source 31 is also connected to the comparator 30, and the comparator provides an output signal which is dependent upon the comparison of the reference voltage from the source 31 and the voltage present on the rail 28. The arrangement is such that when the Zener diode 27 becomes conductive, the comparator 30 provides an output signal on output 32 which is connected to a "power-cut-off" device 33 which then acts to cut off the supply of power to the electrical arrangement.

The output 32 of the comparator may be fed back through a resistance 34 to the input of the comparator to which the rail 28 is connected, thus providing a latch effect. A switch 35 may be provided to connect the said input of the comparator to earth in order to de-activate the latch, thus enabling the device to be re-set following a situation when the "power cut-off" device has been activated.

It is thus to be appreciated that should the discharge tube 19 go open circuit for any reason, the capacitance 21 will resonate giving rise to high voltage present at the output 7 of the inductor 5, this high voltage being in excess of 12 volts in the present example. This will cause the capacitance 25 to charge up to a voltage in excess of 12 volts, in turn leading the Zener diode 27 to become conductive, passing a signal to the comparator 30 which then produces an output signal operating the power cut-off device 33. The comparator will remain "latched" until the switch 35 is closed.

There is, inevitably, a certain amount of "leakage" by capacitative coupling, of current flowing in a circuit. The leakage is greater from a high voltage high frequency circuit, than from a low voltage circuit. The point X which is on the conductor 14 midway between the two secondary windings 15,16 of the transformers 12,13 might be expected, because of the symmetry of the situation, to be at a constant voltage. However, as a consequence of the leakage this voltage may fluctuate slightly. Since the entire circuit only includes a very small part which operates at a high voltage, the overall natural "leakage" is very small.

Should there be any significant leakage, for example if a person touches part of the electrical arrangement illustrated, the voltage at the point X will move significantly.

In the illustrated embodiment the point X is therefore connected, by means of a lead 40 to a resistance 41 connected in series with a capacitance 42, the output of the capacitance 42 being connected to a node 43 which is connected to earth by means of a further resistance 44, although the node 43 may be connected to earth by means of a diode instead of the resistance 44. The combination of the resistance 41, the capacitance 42, and the further resistance 44 are intended to "shift" the voltage present at the node X. The node 43, which carries the "shifted" voltage is connected by means of a Zener diode 45, which has a break-down voltage of 10 volts, to the rail 28.

Thus, if the voltage present at the point X moves beyond a predetermined limit, the Zener diode 45 will become conductive, with the same effect as if the Zener diode 27 becomes conductive. In other words the voltage present on the rail 28, which is compared with the reference voltage from the reference voltage source 31, is then such that the comparator 30 provides an output signal on output 32 which activates the power cut-off device 33. Again the latch will operate, until the switch 35 is closed.

The elimination of high voltage leads makes this type of safety power cut-off arrangement viable.

Figure 3:
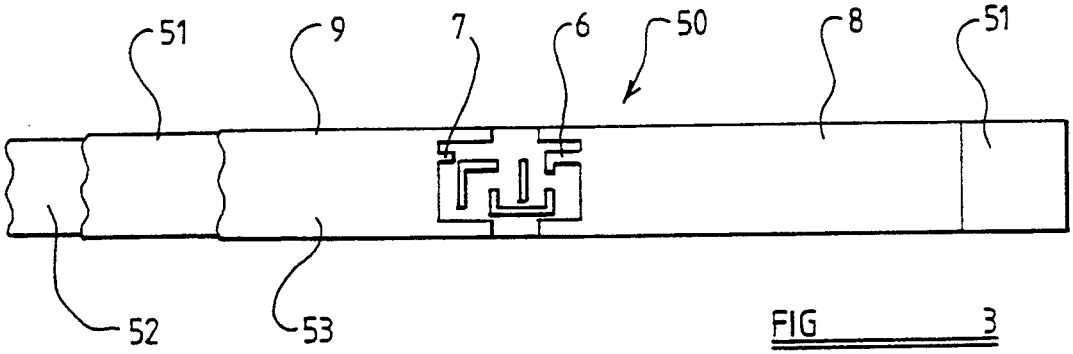
FIG. 3 is a top view, with parts cut away for the sake of clarity of illustration, of a connecting lead used in a preferred embodiment of the invention.

As mentioned above, the leads 8 and 9 are of a preferred form, illustrated, by way of example, in FIG. 3. The leads could, in alternative embodiments of the invention, simply comprise twisted pairs of wires. However, a twisted pair does define a certain amount of "loop" between the pairs, in which a field can be developed, giving rise to interference. In the preferred embodiment of the invention, a flexible feeder is utilized, one of which is illustrated, by way of example and in a partially diagrammatic manner, in FIG. 3. Essentially the flexible feeder illustrated in FIG. 3 comprises a flexible substrate having a thin film of copper (or other electrically conductive material) applied to each of the two opposed sides of the substrate, the copper forming the two opposed sides of the substrate, the copper forming the conductive paths illustrated in FIGS. 1 and 2. The two conductors are therefore extremely close together, being separated only by the flexible substrate, thus minimizing the existence of fields, and minimizing interference. Referring to FIG. 3, a flexible feeder 50 is illustrated. As can be seen towards the left-hand side of FIG. 3, the feeder comprises a central insulating layer 51 formed of a flexible non-conductive material. A thin layer of copper 52 is applied to the reverse side of the substrate FIG. 1 (not visible to FIG. 3 except where cut away at the left-hand side) and a further layer of copper 53 is applied to the upper surface of the insulating substrate. At each end of the substrate (and here reference may be made to the end of the substrate illustrated towards the right of FIG. 3), there is a region of a predetermined length where the copper layer 53 is etched away to reveal the insulating substrate 51. Thus the copper layer 52 extends over the entire length of the reverse face of the substrate 51, whereas the copper layer 53 only extends over a limited extend of the substrate 51, with two end regions of the copper being etched away so that in these regions the substrate 51 is exposed. In the central region the copper layer 53 is etched away to form a predetermined pattern, resemble a printed circuit board. The cooper in this region is to perform the function of the conductors of a printed circuit board. The various components of the square wave generator 1 and the transformer 4 may be connected directly to the flexible lead 50 at this point, the components being mounted on the "printed circuit board" in a conventional manner. The signal tracks for the outputs 6 and 7 of the inductors 4,5 are illustrated, by way of example, in FIG. 3, and it can be seen that the two parts of the cooper layer 53, 8 and 9 are also illustrated.

Figure 4:
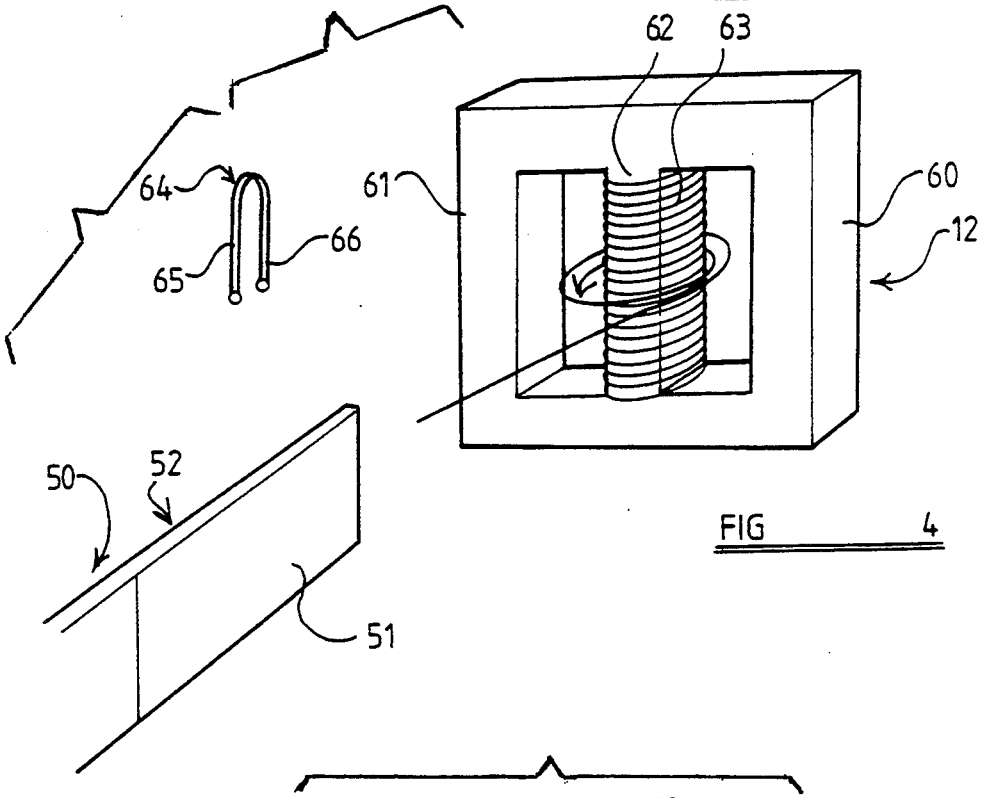
FIG. 4 is a perspective view of the component parts of a transformer in accordance with the invention.

Turning now to FIG. 4 the essential components of a transformer, such as the transformer 12 are illustrated. The transformer comprises a core 60 formed of a suitable material. The core 60 has a typical configuration which is conventionally as an "E" core. The core thus comprises an outer peripheral region or "frame" 61 and a transversely extending element 62 which extends across the frame. A secondary winding 63 is tightly wound on this transversely extending element 62. The winding 63 is equivalent to the secondary winding 15 of the transformer 12 as illustrated in FIGS. 1 and 2. An appropriate insulating layer (not shown) is applied to the top of the winding 63 if the individual turns of the winding are not insulated.

In order to create the primary winding of the transformer, the end region of the flexible connector 50 is introduced into the space between the element 62 on one side of the frame 61 and then wound in a spiral around the element 62, as generally indicated by the arrow 64.

Figure 5:
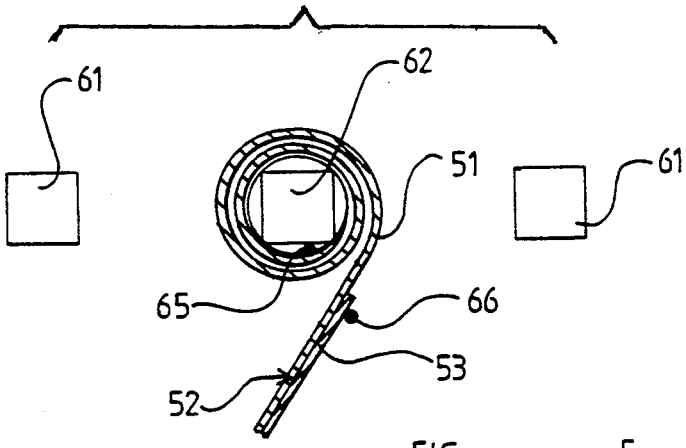
FIG. 5 is a diagrammatic sectional view of a transformer in accordance with the invention made from the components illustrated in FIG. 4.

The end part of the element 50, where the insulating substrate 51 is exposed, is formed into a spiral coil around the element 62 as can be seen most clearly from the diagrammatic sectional view of FIG. 5. It can be seen, from FIG. 5, that the end part of the connector 50, that is to say the part where the copper layer 53 has been etched away to reveal the insulating substrate 51 is coiled with the remaining copper layer 52 on the inside of the coil. Thus the copper layer of each of the outer turns effectively touches the insulating layer exposed on the outer part of the adjacent inner turn.

Whilst, for purpose of illustrating, in FIG. 5 the turns of the coil are shown spaced from each other, in reality the turns would be tight contact with each other and the turns would thus form a very tight coil around the transverse element 62, with the turns embracing the secondary winding 63. When the coil has been formed a metallic clip, such as the clip 64 illustrated in FIG. 4 having two parallel limbs 65,66, is located in position to clip together the turns of the coil and also establish electrical contact between the end part of the inner cooper layer 52 and part of the outer cooper layer 53. The position occupied by the limbs of the clip is illustrated schematically in FIG. 5.

The transformer of FIGS. 4 and 5 is compact, and has a coupling factor approaching unity.

In a modified embodiment the transformer may have a pot core.

What is claimed is:

1. An electrical arrangement, said arrangement comprising a circuit adapted to supply current to a discharge tube, the arrangement comprising a source of relatively low voltage alternating current, two transformers, each having a coupling factor in excess of 0.98, the transformers each being located adjacent an electrode of the discharge tube and being connected thereto, the source of low voltage alternating current being connected to said transformers so that said transformers provide an alternating high voltage current to the discharge tube, wherein the primary windings of the two transformers are connected in series.

2. An arrangement according to claim 1 wherein each transformer has a coupling factor in excess of 0.99.

3. An electrical arrangement according to claim 1 wherein each transformer has a coupling factor of approximately 1.

4. An electrical arrangement according to claim 1 wherein the secondary windings of the two transformers are connected together in series, and are connected to the electrodes of the discharge tube.

5. An electrical arrangement according to claim 4 wherein a single conductor is used to connect the primary and secondary windings of the two transformers in series.

6. An electrical arrangement according to claim 1 wherein the low voltage source of alternating current comprises a square wave generator developing anti-phase square wave signals.

7. An electrical arrangement according to claim 6 wherein the anti-phase square wave signals are passed through the respective coils of a third transformer before being supplied to said two transformers.

8. An electrical apparatus according to claim 7 wherein means are provided for passing the signal from said third transformer to said two transformers which comprise a flexible substrate provided with a layer of a conductor, forming the necessary conductive path, on each of the two opposed sides of the flexible substrate.

9. An electrical arrangement according to claim 8 wherein at least one end region of the flexible substrate is such that a conductive layer is only provided on one side of the flexible substrate, that region being wound in a spiral to form the primary winding of a transformer, the secondary winding being wound on to a core located within the said spiral, means being provided to connect the conductive layer on the interior of the spiral with a conductive layer on the exterior of the substrate to complete the appropriate circuit.

10. An electrical arrangement according to claim 1 provided with means to detect abnormal operation off the arrangement and to cut of the power supplied to the arrangement in the event that abnormal operation is detected.

11. An electrical arrangement according to claim 4 wherein resonance capacitor means are provided connected across the conductive paths supplying the primary windings of the transformers.

12. An electrical arrangement according to claim 7 wherein a resonance capacitor is connected across the outputs of the said further transformer.

13. An electrical arrangement according to claim 12 wherein a node connected to one terminal of the capacitor is connected, through a reverse bias diode, to one terminal of a capacitor, the other terminal of which is earthed, that terminal of the capacitor being connected through a Zener diode having a predetermined breakdown voltage to a comparator provided with a reference voltage, the comparator being adapted to provide an output signal when the voltage present on the node exceeds a predetermined threshold.

14. An electrical arrangement according to claim 4 wherein a node on the conductor connecting the secondary and/or primary windings of the said two transformers is connected to a Zener diode having a predetermined break-down voltage, and then to a comparator adapted to compare a signal described from the Zener diode with a reference voltage, the comparator being adapted to generate an output to activate a power cut-off device.

15. An electrical arrangement according to claim 14 wherein means are provided, between the node and the Zener diode, to shift the voltage.

16. An electrical arrangement according to claim 15 wherein the means to shift the voltage comprise the series connection of a resistance and a capacitance, the output terminal of the capacitance being connected to earth by means of a further resistance or diode.

17. An electrical arrangement according to claim 13 wherein the comparator is provided with a latch.

18. An electrical arrangement according to claim 14 wherein the comparator is provided with a latch.

19. An electrical arrangement, said arrangement comprising a circuit adapted to supply current to a discharge tube, the arrangement comprising a square wave generator developing anti-phase square wave signals, two transformers, each having a coupling factor in excess of 0.98, the transformers each being located adjacent an electrode of a discharge tube and being connected thereto, the square wave generator being connected to said transformers so that said transformers provide an alternating high voltage current to the discharge tube.

20. The electrical arrangement according to claim 19 wherein the anti-phase square wave signals are passed through the respective coils of a third transformer before being supplied to said two transformers.

21. The electrical arrangement according to claim 20 wherein means are provided for passing the signal from said third transformer to said two transformers which comprise a flexible substrate provided with a layer of a conductor, forming the necessary conductive path, on each of the two opposed sides of the flexible substrate.

22. The electrical arrangement according to claim 21 wherein at least one end region of the flexible substrate is such that a conductive layer is only provided on one side of the flexible substrate, that region being wound in a spiral to form the primary winding of a transormer, the secondary winding being wound on to a core located within the said spiral, means being provided to connect the conductive layer on the interior of the spiral with a conductive layer on the exterior of the substrate to complete the appropriate circuit.

* * * * *